US008997386B2

(12) United States Patent
Lee

(10) Patent No.: US 8,997,386 B2
(45) Date of Patent: Apr. 7, 2015

(54) BACKPACK-TYPE LARGE-SCALE PROMOTIONAL MANNEQUIN

(71) Applicant: Sang Hak Lee, Seoul (KR)

(72) Inventor: Sang Hak Lee, Seoul (KR)

( * ) Notice: Subject to any disclaimer, the term of this patent is extended or adjusted under 35 U.S.C. 154(b) by 0 days.

(21) Appl. No.: 14/373,133

(22) PCT Filed: Dec. 28, 2012

(86) PCT No.: PCT/KR2012/011666
§ 371 (c)(1),
(2) Date: Jul. 18, 2014

(87) PCT Pub. No.: WO2013/109002
PCT Pub. Date: Jul. 25, 2013

(65) Prior Publication Data

US 2014/0373408 A1 Dec. 25, 2014

(30) Foreign Application Priority Data

Jan. 19, 2012 (KR) ..... 20-2012-0000488 U

(51) Int. Cl.
*G09F 1/08* (2006.01)
*G09F 21/02* (2006.01)

(52) U.S. Cl.
CPC ..... *G09F 21/026* (2013.01)

(58) Field of Classification Search
CPC ..... A63H 3/06; G09F 21/02
USPC ..... 40/411, 419, 538, 586; 446/226
See application file for complete search history.

(56) References Cited

U.S. PATENT DOCUMENTS

| | | | | |
|---|---|---|---|---|
| 5,892,445 | A * | 4/1999 | Tomich | 340/573.1 |
| 6,163,887 | A * | 12/2000 | Rogers et al. | 2/173 |
| 6,186,857 | B1 * | 2/2001 | Gazit et al. | 446/226 |
| 6,357,049 | B1 * | 3/2002 | Hoffman | 2/69 |
| 6,539,655 | B1 * | 4/2003 | Earle | 40/419 |
| 6,786,793 | B1 * | 9/2004 | Wang | 446/226 |
| 6,843,012 | B1 * | 1/2005 | Dodd | 40/586 |
| 2001/0002492 | A1 * | 6/2001 | Rogers et al. | 2/173 |
| 2007/0199219 | A1 * | 8/2007 | Saliege | 40/586 |
| 2007/0216600 | A1 * | 9/2007 | Langlois | 345/8 |
| 2009/0051561 | A1 * | 2/2009 | Cadavid | 340/691.6 |

FOREIGN PATENT DOCUMENTS

| | | | |
|---|---|---|---|
| JP | 05-033781 | U | 5/1993 |
| JP | 2008-018164 | A | 1/2008 |
| KR | 10-2010-0032760 | A | 3/2010 |
| KR | 20-2011-0009355 | U | 10/2011 |
| KR | 10-2011-0124639 | A | 11/2011 |

* cited by examiner

*Primary Examiner* — Gary Hoge
(74) *Attorney, Agent, or Firm* — Maschoff Brennan

(57) ABSTRACT

The present invention relates to a mannequin, and, more specifically, relates to a large-scale promotional mannequin capable of being manipulated while moving carried on a person's shoulders like a backpack at, for example, various venues or on the streets for the purpose of advertising or promotion. The backpack-type large-scale promotional mannequin according to the present design comprises: a main mannequin body fitted with a blower operated by means of a battery on one side such that air can be injected therein in tube fashion; a support for supporting the main mannequin body from the bottom so as to allow same to be upright; and a backpack means for strapping, onto the shoulders, the main mannequin body supported upright by means of the support.

12 Claims, 6 Drawing Sheets

(a) (b)

(a)

(b)

(c)

BACKPACK-TYPE LARGE-SCALE PROMOTIONAL MANNEQUIN

TECHNICAL FIELD

The present invention relates to a mannequin and, more specifically, to a large-scale promotional mannequin capable of being manipulated while being carried on a person's shoulders like a backpack at, for example, various venues or on the streets for the purpose of advertisement or promotion.

BACKGROUND ART

In general, various mannequins are widely used for a parade at a domestic or overseas theme park and a street parade of a performance team, or for advertisement and promotion of a specific product. Most of these mannequins are sewn dolls which are worn by a person performing various motions while moving. However, this type of mannequins needs to be worn by a person to be used, and thus they are fabricated to have heights or sizes similar to a height or physique of a person. For this reason, attention to such mannequins may be degraded. Moreover, in a hot summer, rise of the temperature inside a mannequin and heavy weight of the mannequin may make manipulation of the mannequin difficult and thus require hard labor and endurance by a performer.

Meanwhile, a large-scale mannequin two more times larger than a person has often been used in a parade of a foreign street performance team or a domestic performance team to conduct advertisement or promotion. FIGS. 1(*a*) and 1(*b*) show photos of scenes of parades using a large-scale mannequin as described above. As shown in FIGS. 1(*a*) and 1(*b*), such large-scale mannequins are even taller than a person and thus easily seen even at a far distance. Accordingly, they may draw greater attention from people, and thus result in greater effects of advertisement and promotion. In addition, they may function as entertainers by stimulating people's curiosities and entertaining people.

However, such large-scale mannequins have not been so popularized in reality. This is because fabrication and maintenance of such mannequins are very difficult and cost too much. In addition, regarding the structure, the frame of the mannequin forming the basis of a mannequin is formed of steel bars as shown in FIG. 1(*a*), and a doll is put on the frame. Accordingly, the mannequin is too heavy. In addition, the fixed head and body make it difficult for a person to manipulate the mannequin while carrying the mannequin.

Meanwhile, Korean Patent Application Publication No. 10-2008-0091780 proposes an air-injection type mannequin. This mannequin is formed of cloth or vinyl and thus advantageously has a light weight as air is injected. However, this mannequin also requires a person to wear and manipulate it, and thus may not bring forth the effect of a large-scale mannequin. Further, in the case that the mannequin is held fixed using a stand, it may be inconvenient to move and manipulate the mannequin.

DISCLOSURE

Technical Problem

An object of the present invention devised to solve the problem lies in a large-scale promotional mannequin that draws greater attention, enhances an advertisement effect, and has a reduced weight to enhance mobility and manipulability.

Technical Solution

The object of the present invention can be achieved by providing a backpack-type large-scale promotional mannequin including a main mannequin body provided with a blower installed at one side thereof and operated by a battery to inject air into the main mannequin body in a tubular fashion, a support for supporting the main mannequin body from under the main mannequin body to allow the main mannequin body to stay upright, and a backpack means for carrying, on the shoulders, the main mannequin body supported upright by the support.

Herein, the support is preferably provided with a telescopic structure to allow a length of the support to be adjusted.

Preferably, the support is inserted into the main mannequin body from a lower portion of a hip of the main mannequin body to support the main mannequin body upright, the lower portion of the hip of the main mannequin body is provided with a support insertion hole, and an interior of the main mannequin body is provided with a support passage communicating with the support insertion hole, in order to insert the support into the main mannequin body, the support passage being a tubular passage.

In addition, the backpack means preferably includes a support plate, the support plate being a plate member configured to support the support from under the support and closely installed on the back of a manipulator of the mannequin, and a backpack strap provided on both left and right sides of the support plate.

Preferably, the backpack means includes a support plate, the support plate being a plate member configured to support the support from under the support and closely installed on the back of a manipulator of the mannequin, and an accommodating backpack configured to accommodate the support plate and the battery for operating the blower and provided with a shoulder strap allowing the manipulator to carry the mannequin on the back.

In addition, the support plate is preferably provided with a support mount having one end coupled to the support plate and the other end coupled to a lower end portion of the support in order to place and mount the support on the support plate, the support plate being constructed with a tubular body vertically fixed and coupled to a rear surface of the support plate disposed vertically and having a closed lower end portion.

In addition, the support plate is preferably provided with a stand mount formed in a shape of a tubular body having a closed upper end and an open lower end, and a stand inserted into the stand mount from under the stand mount.

Preferably, a rear surface of the accommodating backpack is provided with a banner holder allowing the advertising banner to be held thereon, a front surface of the banner holder is provided with a penetrating pin fastened and fixed by a fastener after the penetrating pin penetrates the rear surface of the accommodating backpack from an outside of the rear surface to an inside of the rear surface, and a periphery of the banner holder is provided with a plurality of insertion holes allowing the banner support for supporting the advertising banner to be fitted thereinto.

Advantageous Effects

According to one embodiment of the present invention, a mannequin has a large size, and thus may draw greater attention and enhance the advertisement effect. In addition, the mannequin is provided with an air-injected main body, and thus may be light. Thereby, a large-scale mannequin for advertisement which is easy to manipulate and move may be provided.

REFERENCE NUMERALS

| |
|---|
| 10: Main mannequin body |
| 11: Air inlet |
| 12: Blower |
| 14: Battery |
| 15: Zipper |
| 16: Support insertion hole |
| 18: Support passage |
| 20: Manipulation stick |
| 30: Support |
| 40: Backpack means |
| 42: Support plate |
| 44: Support mount |
| 45: Stand mount |
| 46: Stand |
| 48: Accommodating backpack |
| 50: Banner holder |
| 52: Penetrating pin |
| 54: Fastener |
| 56: Insertion hole |
| 58: Reinforcing wire mesh |
| 60: Banner |
| 62: Banner support |

BEST MODE

Reference will now be made in detail to the preferred embodiments of configuration and operation of a backpack-type large-scale promotional mannequin of the present invention, examples of which are illustrated in the accompanying drawings.

Figure 1:
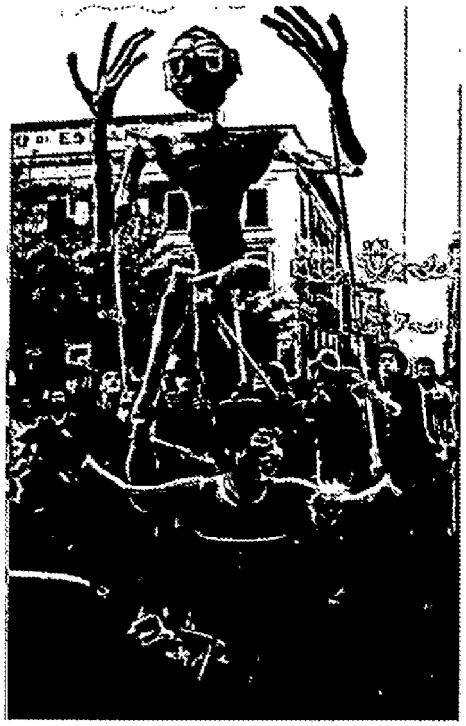
FIG. 1 shows a photo of a conventional large-scale promotional mannequin in use.
Figure 1:
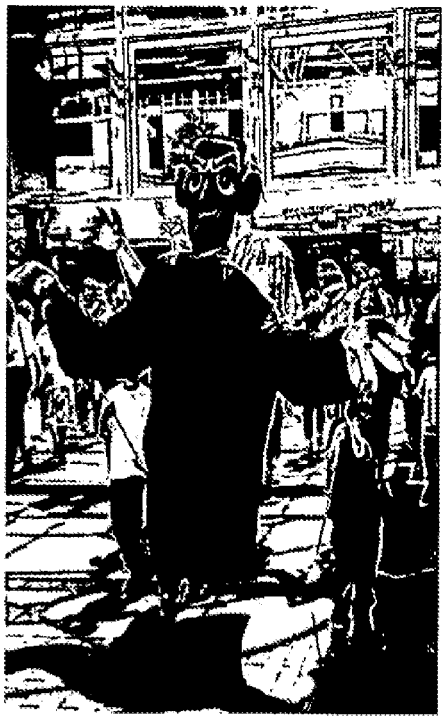
Figure 1:
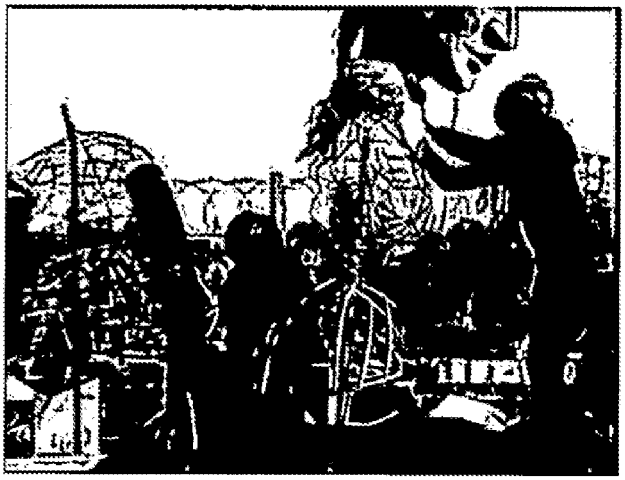
Figure 2:
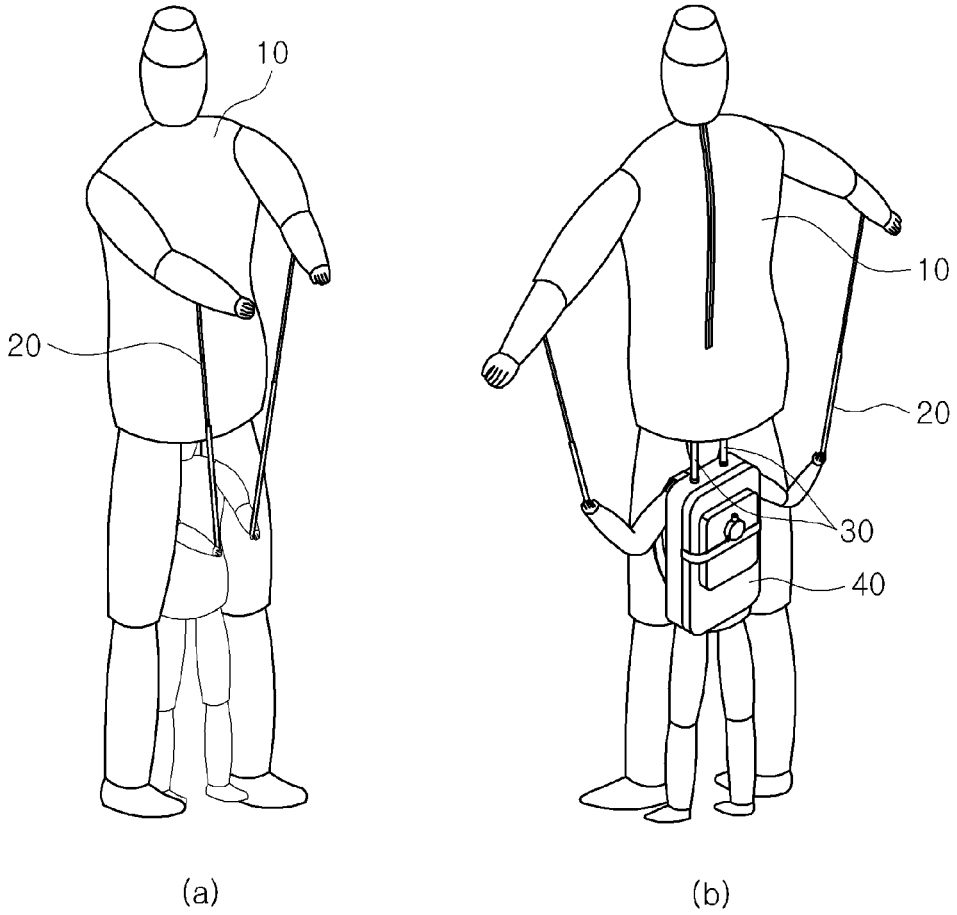
FIG. 2 is a view illustrating the state of a backpack-type large-scale promotional mannequin in use according to the present invention.
Figure 3:
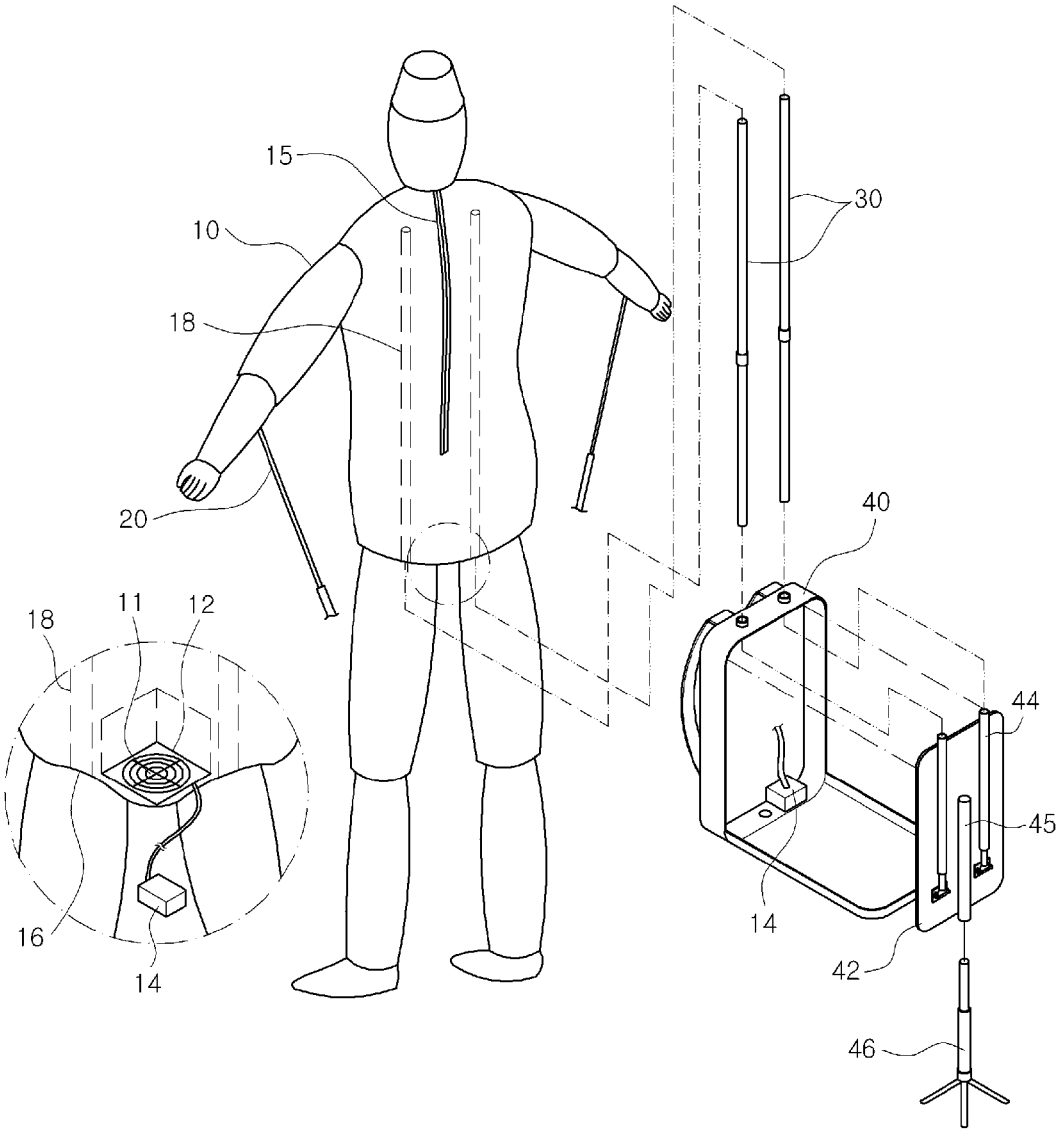
FIG. 3 is an exploded view illustrating the backpack-type large-scale promotional mannequin according to the present invention.

FIG. 2 is a view illustrating the state of a backpack-type large-scale promotional mannequin in use according to the present invention, and FIG. 3 is an exploded view illustrating the backpack-type large-scale promotional mannequin according to the present invention. As shown in FIG. 2, the backpack-type large-scale promotional mannequin allows a manipulator to put his/her head between the legs of a main mannequin body 10 in a manner that the mannequin is placed and supported on the manipulator's neck and to manipulate the hands of the mannequin. As shown in FIGS. 2 and 3, the backpack-type large-scale promotional mannequin includes a main mannequin body 10, a manipulation stick 20, a support 30, a backpack means 40, and a banner holder 50.

The main mannequin body 10, whose height is about 1.5 to 2 times the height of a person, may be a human-like doll including a head, arms, a body and legs, or may have the shape of a character or a specific object. The main mannequin body 10 is formed of cloth, vinyl or a synthetic resin such as rubber such that air can be injected therein as in the case of a tube. As the main mannequin body 10 is configured like an air tube, a mannequin having a relatively large size may be fabricated to have a light weight, and maintenance can be implemented for the mannequin. Particularly, mobility and manipulability may be enhanced.

Preferably, a blower 12 is mounted on one side of the mannequin, more preferably, on the hip of the mannequin such that air can be injected into the main mannequin body 10. The blower 12, which is a means to suction external air and blow the air into the main mannequin body 10, is fixed to the inner side of the hip of the main mannequin body 10, with a suction inlet thereof aligned with an air inlet 11 formed at the main mannequin body 10 so as to suction the external air. In addition, the blower 12 may be connected to a separate external battery 14 and an electric wire, and may be operated and stopped by a separate switch. Preferably, the battery 14 is accommodated in an accommodating backpack 48 of the backpack means 40, which will be described later.

The blower 12 may suction and inject air into the main mannequin body 10, or may be provided with an inner impeller adapted to rotate normally and reversely to inject air or discharge injected air.

In the case that the blower 12 can only rotates in one direction, i.e., can only inject air, installing a battery 14 capable of opening and closing the main mannequin body 10 may facilitates discharge of air and disassembly and accommodation of the main mannequin body 10.

As shown in FIGS. 2 and 3, the manipulation stick 20 is a long stick connected to a hand portion of the main mannequin body 10. The manipulation stick 20 allows a manipulator to manipulate movement of the mannequin gripping and moving the manipulation stick 20 with the mannequin supported on the shoulders of the manipulator. While the manipulation stick 20 is illustrated as being provided only to the hand portion of the mannequin, it may also be provided to the body or face of the mannequin, when necessary. Preferably, the manipulation stick 20 has a telescopic structure allowing the manipulation stick 20 to be adjusted according to the physical condition of the manipulator such as height and length of arms.

As shown in FIGS. 2 and 3, the support 30, which serves to support the main mannequin body 10 upward to allow the main mannequin body 10 to stand upright, is preferably configured with a long stick structure, and is preferably provided with a telescopic structure to allow adjustment of elevation according to the size of the main mannequin body 10 and facilitate disassembly and management. One pair of supports 30 are provided to the left and right parts respectively, and inserted into the main mannequin body 10 from the lower portion of the main mannequin body 10, preferably, from the lower portion of the hip thereof so as to support the main mannequin body 10 upright.

In order to insert the supports 30 into the main mannequin body 10, support insertion holes 16 are formed in the lower portion of the main mannequin body 10, preferably in the left and right parts of the lower portion of the hip, and support passages 18 connected to the support insertion holes 16 are vertically disposed inside the main mannequin body 10. Preferably, the support passages 18, which serve as passages for the support 30 that allow the support 30 to pass therethrough to be inserted into and installed in the main mannequin body 10 without causing leakage of air injected into the main mannequin body 10, are constructed as tubular passages communicating with the support insertion holes 16 and isolated from the air injected into the main mannequin body 10. The lower end of the support passages 18 is connected to the support insertion hole 16 and the other end thereof is coupled to the inner uppermost end of the main mannequin body 10 and closed to prevent the upper end of the support 30 from passing through the other end. Preferably, a stitched part of the support passages 18 is subjected to seam sealing to prevent infiltration of the injected air in the main mannequin body 10.

Figure 4:
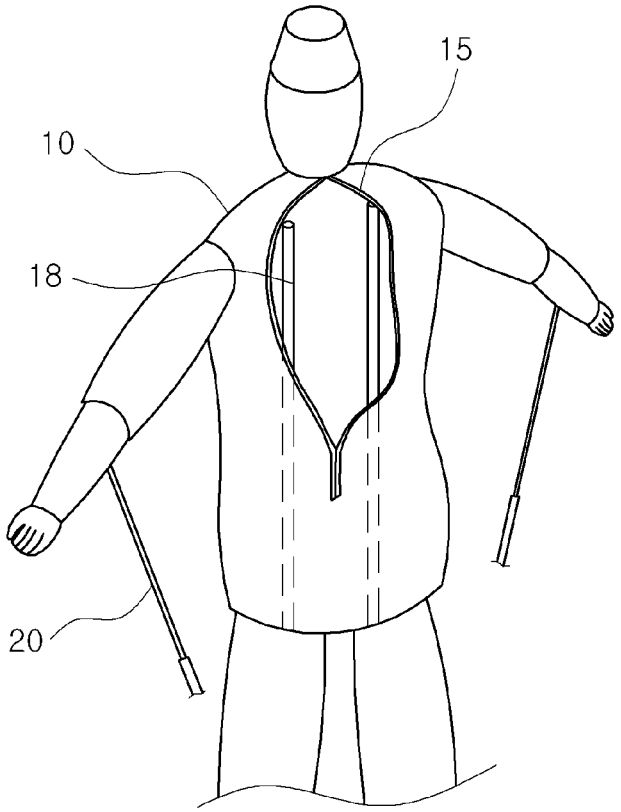
FIG. 4 is a cutaway perspective view illustrating the body of the backpack-type large-scale promotional mannequin according to the present invention.
Figure 5:
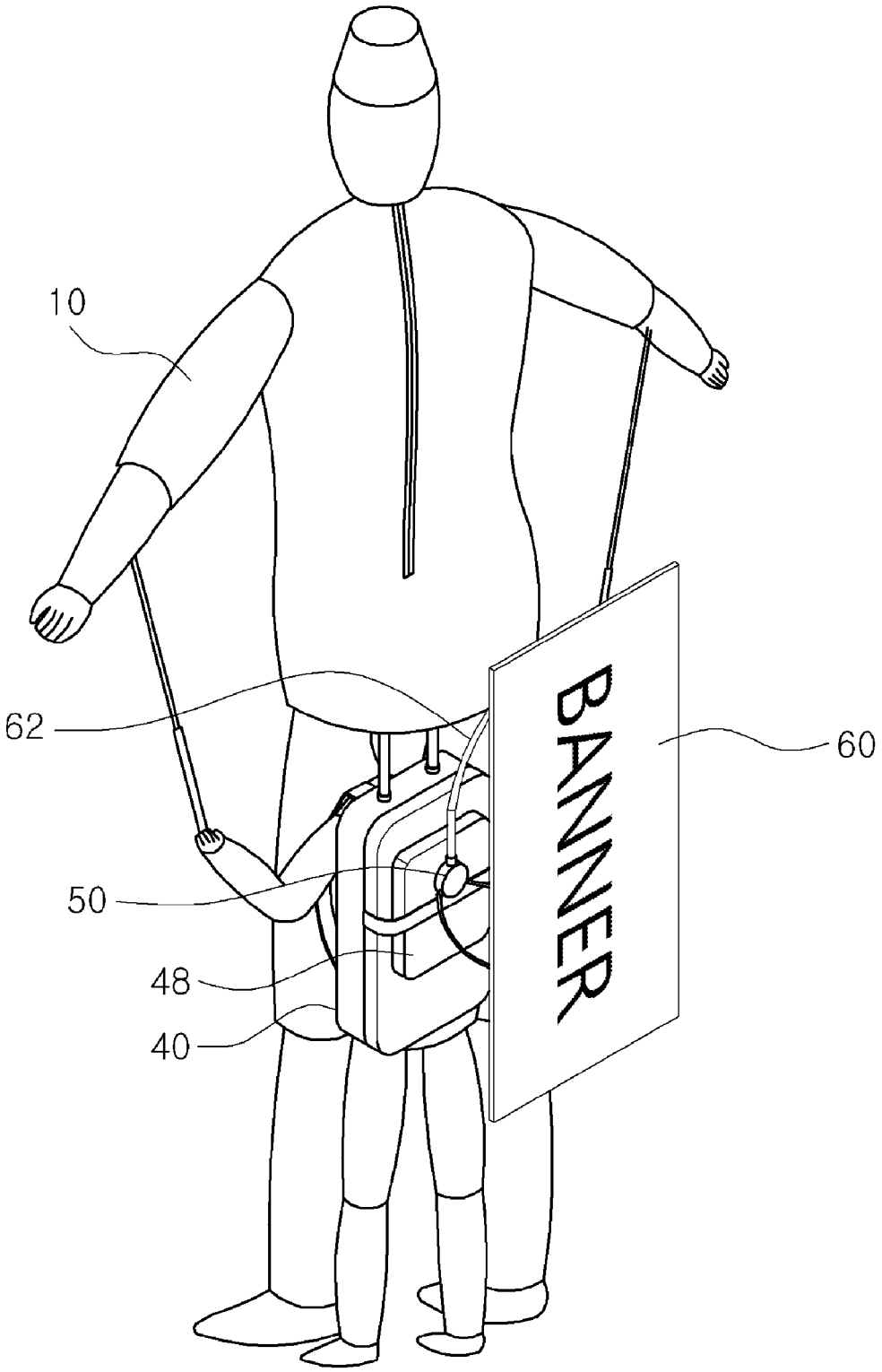
FIG. 5 is a view illustrating the backpack-type large-scale promotional mannequin according to the present invention with a banner for advertisement installed on a support backpack.

FIG. 4 shows the support passages 18 installed in the main mannequin body 10, by opening the battery 14 formed on one side of the main mannequin body 10. Preferably, the support passages 18 are formed of cloth, vinyl or a synthetic resin such as rubber that constructs the main mannequin body 10. It may also be possible to install the support passages 18 such that the support passages 18 are exposed to the exterior of the main mannequin body 10.

Through the configuration as above, the support 30 is vertically installed by being inserted into the support insertion hole 16 from the lower portion, preferably the hip of the main mannequin body 10, and being passed through the support passage 18. Thereby, the main mannequin body 10 can be supported upright by the support 30.

The backpack means 40, with which the manipulator carries the main mannequin body 10 supported upright by the support 30 on the shoulders, includes a support plate 42, a support mount 44, and an accommodating backpack 48.

The support plate 42, which is a plate member adapted to support the support 30 from under the support 30 and closely installed on the back of the manipulator, may be formed of a metallic member such as an iron sheet and a tin sheet or wood. The support plate 42, which may be constructed in the form of a block, is preferably constructed with a vertically extending thin plate in consideration of wearability on the back of the manipulator.

As described above, the support plate 42 supports the support 30, which supports the main mannequin body 10 upright, from under the support 30. To this end, the support plate 42 is provided with a support mount 44. The support mount 44, which is provided with one end coupled to the support plate 42 and the other end coupled to the lower end portion of the support 30 to place and mount the support 30 on the support plate 42, is constructed with a tubular body vertically fixed and coupled to the rear surface (the surface opposing the surface facing the back of the manipulator) of the support plate 42, which is vertically disposed. The support mount 44 is fixedly installed on the rear surface of the support plate 42 by a fastener 54 such as a bolt, and the lower end portion thereof is closed to prevent the support 30 from passing therethrough. The lower end portion of the support mount 44 may be fixedly coupled to the support 30, or rotatably hinged to the support plate 42. Preferably, one pair of support mounts 44 corresponding to the number of the support 30 is provided on the left and right sides.

With the configuration as above, the support 30 may be vertically placed on the support mount 44 by simply inserting the lower end of the support 30 into the support mounts 44 from above the support mounts 44.

In addition, a stand mount 45 formed in the shape of a tube having a closed upper end and an open lower end is provided on the rear surface of the support plate 42, and a stand 46 inserted thereinto from under the stand mount 45 is preferably provided. Preferably, the lower portion of stand 46 is provided with a tripod to be easily supported on the ground. Through this configuration, the mannequin may be placed on the ground using the stand 46 in order to be used.

Although not shown in the figures, backpack straps may be provided on both left and right sides of the front surface of the support plate 42. Given the backpack straps formed on the support plate 42, the manipulator may carry the support plate 42 on the back by hanging the backpack straps on the shoulders.

However, in the case that the backpack straps are directly installed on the support 30, the support 30, the support mount 44 and the stand mount 45 are exposed outward, which degrades the aesthetics of appearance and makes it difficult to accommodate the battery 14 for operating the blower 12 provided to the main mannequin body 10. Accordingly, an accommodating backpack 48 is preferably provided.

The accommodating backpack 48, which is an accommodation bag adapted to accommodate the support plate 42 and the battery 14 and carried on the back of the manipulator to maintain the upright position of the main mannequin body 10, may generally employ a backpack having straps hung on the shoulders, or may be specially fabricated to be suitable for accommodation and installation of the support plate 42 and the support 30.

FIG. 3 shows an example of a typical backpack employed as the accommodating backpack 48. As shown in FIG. 3, the support plate 42 with the support mount 44 and the stand mount 45 coupled thereto and the battery 14 are accommodated in the accommodating backpack 48 together with the support plate 42 vertically positioned. At this time, in the case that a pocket is formed on the inner surface of the back plate of the accommodating backpack 48, the support plate 42 may be accommodated in the pocket. In the case that the pocket is not provided, the support plate 42 is preferably fixed to an inner surface of the backpack with a separate strap or the fastener 54. In order to couple the support mount 44 and the stand mount 45 to the support 30 and the stand 46 respectively, through holes allowing the support 30 and the stand 46 to be fitted thereinto are preferably formed in the upper and lower portions of the accommodating backpack 48. The support 30 and the stand 46 may be passed through the through holes, inserted into the accommodating backpack 48, and then coupled to the support mount 44 and the stand mount 45 respectively.

As such, the accommodating backpack 48 may be used to easily accommodate the support plate 42 and be easily moved with the main mannequin body 10 carried on the back of the manipulator by being hung on the shoulders of the manipulator, thereby allowing the manipulator's hands to freely move. Accordingly, the manipulator may easily manipulate movement of the mannequin with the manipulation stick 20.

Figure 6:
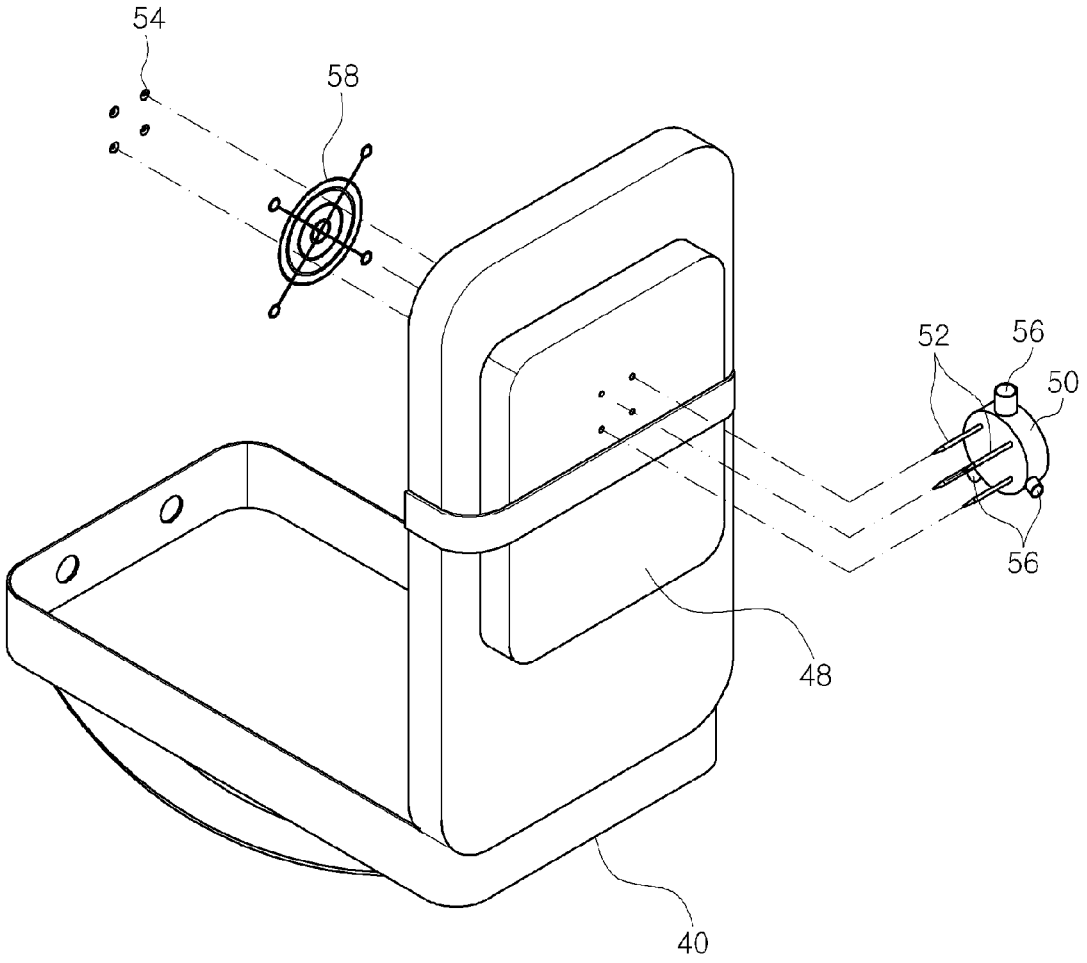
FIG. 6 is an exploded view illustrating coupling constituents of a banner holder.

FIG. 6 is a view showing an advertising banner 60 installed on the backpack means 40, more specifically, on the rear surface of the accommodating backpack 48, and FIG. 7 is an exploded view illustrating a coupling structure of a banner holder 50 for holding the advertising banner 60 on the accommodating backpack 48.

As shown in the figures, the banner holder 50 is provided with an approximately circular disc or block, and the front surface thereof is provided with penetrating pins 52 penetrating the accommodating backpack 48 from the exterior of the rear surface of the accommodating backpack 48 to the interior thereof. The fasteners 54 such as nuts or rivets are fitted onto the penetrating pins 52 in the accommodating backpack 48 in order to fix the penetrating pins 52 having penetrated the rear surface of the accommodating backpack 48. To further securely fix the fasteners 54, a reinforcing wire mesh 58 is preferably provided inside the accommodating backpack 48. The penetrating pins 52 may pass through the holes of the reinforcing wire mesh 58 and the fasteners 54 may be supported in the reinforcing wire mesh to securely support the banner holder 50 outside the reinforcing wire mesh. After being fastened to the fasteners 54, the ends of the penetrating pins 52 are cut off.

In addition, a plurality of insertion holes 56 allowing the banner support 62 supporting the banner 60 to be fitted thereinto may be formed in the periphery of the banner holder 50 and spaced a predetermined distance from each other. According to the above configuration, by securely fitting the banner support 62 of the advertising banner 60 into the insertion holes 56 in the upward, downward or lateral direction, the advertising banner 60 may be securely supported on the accommodating backpack 48, allowing effective advertisement while being carried around.

Configuration and operation of a large-scale promotional mannequin according to preferred embodiments have been described above. It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A backpack-type large-scale promotional mannequin comprising:

a main mannequin body provided with a blower installed at one side thereof and operated by a battery to inject air into the main mannequin body in a tubular fashion;

a support for supporting the main mannequin body from under the main mannequin body to allow the main mannequin body to stay upright; and a backpack means for carrying, on the shoulders, the main mannequin body supported upright by the support.

2. The backpack-type large-scale promotional mannequin according to claim 1, wherein the support is provided with a telescopic structure to allow a length of the support to be adjusted.

3. The backpack-type large-scale promotional mannequin according to claim 1, wherein the support is inserted into the main mannequin body from a lower portion of a hip of the main mannequin body to support the main mannequin body upright.

4. The backpack-type large-scale promotional mannequin according to claim 3, wherein the lower portion of the hip of the main mannequin body is provided with a support insertion hole, and an interior of the main mannequin body is provided with a support passage communicating with the support insertion hole, in order to insert the support into the main mannequin body, the support passage being a tubular passage.

5. The backpack-type large-scale promotional mannequin according to claim 1, wherein the backpack means comprises a support plate, the support plate being a plate member configured to support the support from under the support and closely installed on the back of a manipulator of the mannequin, and a backpack strap provided on both left and right sides of the support plate.

6. The backpack-type large-scale promotional mannequin according to claim 1, wherein the backpack means comprises a support plate, the support plate being a plate member configured to support the support from under the support and closely installed on the back of a manipulator of the mannequin, and an accommodating backpack configured to accommodate the support plate and the battery for operating the blower and provided with a shoulder strap allowing the manipulator to carry the mannequin on the back.

7. The backpack-type large-scale promotional mannequin according to claim 5, wherein the support plate is provided with a support mount having one end coupled to the support plate and the other end coupled to a lower end portion of the support in order to place and mount the support on the support plate, the support plate being constructed with a tubular body vertically fixed and coupled to a rear surface of the support plate disposed vertically and having a closed lower end portion.

8. The backpack-type large-scale promotional mannequin according to claim 5, wherein the support plate is provided with a stand mount formed in a shape of a tubular body having a closed upper end and an open lower end, and a stand inserted into the stand mount from under the stand mount.

9. The backpack-type large-scale promotional mannequin according to claim 6, wherein a rear surface of the accommodating backpack is provided with a banner holder allowing the advertising banner to be held thereon.

10. The backpack-type large-scale promotional mannequin according to claim 9, wherein a front surface of the banner holder is provided with a penetrating pin fastened and fixed by a fastener after the penetrating pin penetrates the rear surface of the accommodating backpack from an outside of the rear surface to an inside of the rear surface, and a periphery of the banner holder is provided with a plurality of insertion holes allowing the banner support for supporting the advertising banner to be fitted thereinto.

11. The backpack-type large-scale promotional mannequin according to claim 6, wherein the support plate is provided with a support mount having one end coupled to the support plate and the other end coupled to a lower end portion of the support in order to place and mount the support on the support plate, the support plate being constructed with a tubular body vertically fixed and coupled to a rear surface of the support plate disposed vertically and having a closed lower end portion.

12. The backpack-type large-scale promotional mannequin according to claim 6, wherein the support plate is provided with a stand mount formed in a shape of a tubular body having a closed upper end and an open lower end, and a stand inserted into the stand mount from under the stand mount.

* * * * *